US006340007B2

(12) United States Patent
Di Lieto et al.

(10) Patent No.: US 6,340,007 B2
(45) Date of Patent: Jan. 22, 2002

(54) METHOD FOR ESTIMATING THE END-OF-STROKE POSITIONS OF MOVING MEMBERS OF ELECTROMAGNETIC ACTUATORS FOR THE ACTUATION OF INTAKE AND EXHAUST VALVES IN INTERNAL COMBUSTION ENGINES

(75) Inventors: Nicola Di Lieto, Salerno; Gilberto Burgio, Ferrara; Roberto Flora, Forli', all of (IT)

(73) Assignee: Magneti Marelli S.p.A., Milan (IT)

( * ) Notice: Subject to any disclaimer, the term of this patent is extended or adjusted under 35 U.S.C. 154(b) by 0 days.

(21) Appl. No.: 09/739,799

(22) Filed: Dec. 20, 2000

(30) Foreign Application Priority Data

Dec. 23, 1999 (IT) ..... BO99A0710

(51) Int. Cl.[7] ..... F01L 9/04

(52) U.S. Cl. ..... 123/90.11; 251/129.01; 251/129.15

(58) Field of Search ..... 123/90.11; 251/129.01, 251/129.05, 129.15, 129.16

(56) References Cited

U.S. PATENT DOCUMENTS 4,957,074 A 9/1990 Weissler, II et al. ..... 123/90.11
6,176,208 B1 * 1/2001 Tsuzuki et al. ..... 123/90.11
6,196,172 B1 * 3/2001 Cosfeld et al. ..... 123/90.11
6,279,523 B1 * 8/2001 Iida et al. ..... 123/90.11

FOREIGN PATENT DOCUMENTS

| | | |
|---|---|---|
| DE | 197 39 840 A | 3/1999 |
| EP | 0 844 370 A | 5/1998 |
| EP | 0 916 815 A | 5/1999 |

* cited by examiner

*Primary Examiner*—Weilun Lo
(74) *Attorney, Agent, or Firm*—Arent Fox Kintner Plotkin & Kahn, PLLC

(57) ABSTRACT

A method for estimating the end-of-stroke positions of moving members of electromagnetic actuators for the actuation of intake and exhaust valves in internal combustion engines in which an actuator is coupled to a respective intake or exhaust valve and comprises a moving member actuated magnetically in order to control the movement of the valve, a sensor supplying a position signal representative of a current position of this moving member and a first and a second electromagnet disposed on opposite sides of the moving member, wherein this moving member can move between a first end-of-stroke position in which it is disposed in contact with the first electromagnet and a second end-of-stroke position in which it is disposed in contact with the second electromagnet. The method comprises the stages of checking whether the condition of stationary contact of the moving member exists and determining a magnitude correlated with this current position, if the stationary condition is verified.

6 Claims, 4 Drawing Sheets

METHOD FOR ESTIMATING THE END-OF-STROKE POSITIONS OF MOVING MEMBERS OF ELECTROMAGNETIC ACTUATORS FOR THE ACTUATION OF INTAKE AND EXHAUST VALVES IN INTERNAL COMBUSTION ENGINES

The present invention relates to a method for estimating the end-of-stroke positions of moving members of electromagnetic actuators for the actuation of intake and exhaust valves in internal combustion engines.

BACKGROUND OF THE INVENTION

As is known, drive units are currently being tested in which the actuation of the intake and exhaust valves is managed by using actuators of electromagnetic type, which replace purely mechanical distribution systems (camshafts).

These actuators in particular comprise a pair of electromagnets disposed on opposite sides of a moving ferromagnetic member connected to a respective intake or exhaust valve and held in a rest position by elastic members (for instance a spring and/or a torsion bar). The moving ferromagnetic member is actuated by applying a force generated by the electromagnets in order to be brought into contact alternatively with one or other of these electromagnets, so as to move the corresponding valve between a closed position and a position of maximum opening according to desired timings and trajectories. In this way, it is possible to actuate the valves according to optimum lift profiles in any operating condition of the engine, thereby substantially improving overall performance.

Obtaining an actual increase in the efficiency of the engine is conditioned, however, by the precision of the systems and methods used for the control of the actuators. In order, in particular, accurately to control the force transmitted by the electromagnets to the moving member and thus the movement of the valve, it is indispensable to have an accurate measurement of the distances intervening between the moving member and the polar heads of one or the other electromagnet. As shown by way of example in FIG. 1, the force F that an electromagnet is able to transmit to the moving member depends, the current absorption being equal, in a highly non-linear manner on the distance D between the polar head of the electromagnet and the moving member. An error, even of a few microns, in the measurement of the distance D, in particular for low values of the latter, may therefore compromise the efficiency of the control and thus entail a substantial deterioration of the performance of the engine.

This is a serious drawback, given that internal combustion engines are subject, during their use, to substantial temperature variations which cause expansions and/or contractions of the materials, especially of the metal parts. Consequently, even the polar heads of the electromagnets may expand or contract as a function of temperature, thereby affecting the measurement of the distances between these electromagnets and the moving member.

SUMMARY OF THE INVENTION

The object of the present invention is to provide a method for estimating the end-of-stroke positions of the moving member which makes it possible to remedy the above-mentioned drawbacks and, in particular, makes it possible to reduce the overall consumption of electrical power.

The present invention therefore relates to a method for estimating the end-of-stroke positions of moving members of electromagnetic actuators for the actuation of intake and exhaust valves in internal combustion engines, in which an actuator is coupled to a respective intake or exhaust valve and comprises a moving member actuated magnetically in order to control the movement of the valve, a sensor supplying a position signal representative of a current position of this moving member and a first and a second electromagnet disposed on opposite sides of this moving member, wherein this moving member can move between a first end-of-stroke position in which it is disposed in contact with the first electromagnet and a second end-of-stroke position in which it is disposed in contact with the second electromagnet, which method is characterised in that it comprises the stages of:

a) checking whether the moving member is in a condition of stationary contact; and b) determining a magnitude correlated with this current position, if the condition of stationary contact is verified.

BRIEF DESCRIPTION OF THE DRAWINGS

The invention is set out in further detail below with reference to an embodiment thereof, given purely by way of non-limiting example and made with reference to the accompanying drawings, in which.

DETAILED DESCRIPTION OF THE INVENTION

Figure 2A:
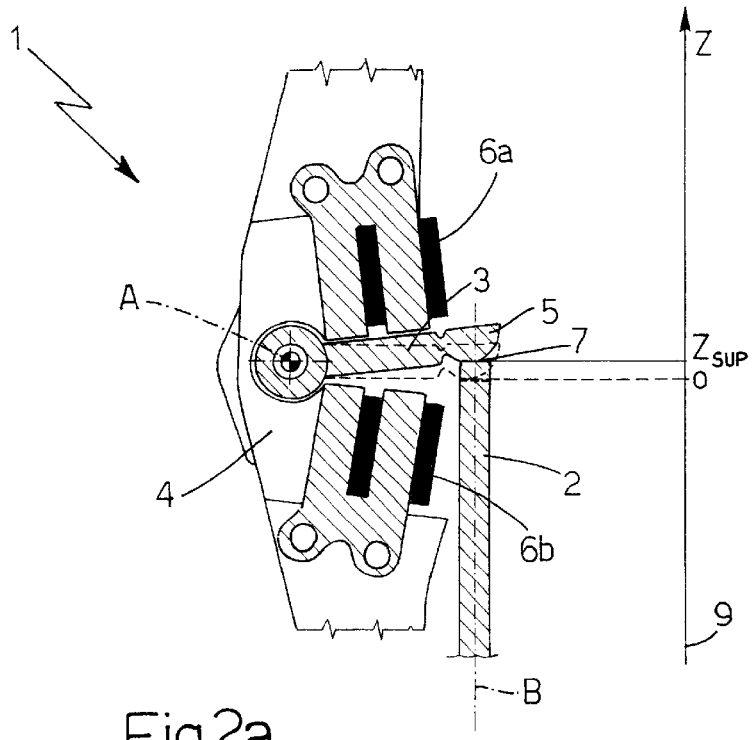
FIGS. 2*a* and 2*b* are lateral elevations, partly in cross-section, of an electromagnetic actuator and the corresponding intake or exhaust valve in a first and a second end-of-stroke position respectively.
Figure 2B:
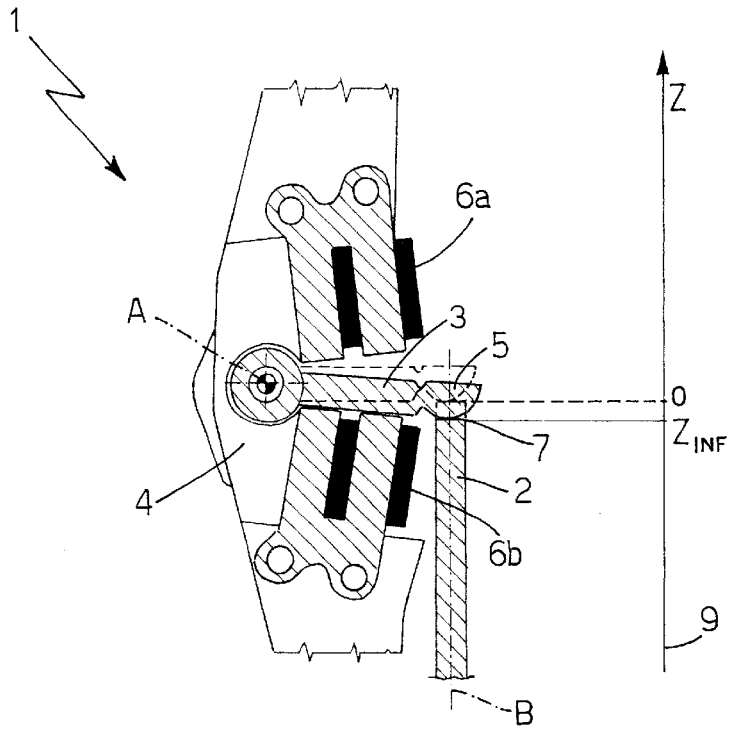

In FIGS. 2*a* and 2*b*, an electromagnetic actuator 1 is coupled to an intake or exhaust valve 2 of an internal combustion engine. The actuator 1 comprises an oscillating arm 3 of ferromagnetic material having a first end hinged on a fixed support 4 so as to be able to rotate about a horizontal axis of rotation A perpendicular to a longitudinal axis B of the valve 2. A second end 5 of the oscillating arm 3 cooperates in contact, moreover, with an upper end of the valve 2 so as to impose an alternating movement in a direction parallel to the longitudinal axis B on this valve 2.

The actuator 1 comprises a closing electromagnet 6*a* and an opening electromagnet 6*b* disposed on opposite sides of the body of the oscillating arm 3, in order to be able to act on command, in sequence or simultaneously, by exerting a net force on the oscillating arm 3 in order to cause it to rotate about the axis of rotation A.

Moreover, a first and second elastic member, for instance a spring and a torsion bar, not shown for the sake of simplicity, act so that the oscillating arm 3 is maintained in a rest position in which it is equidistant from the polar heads of the closing and opening electromagnets 6*a* and 6*b* respectively.

FIGS. 2*a* and 2*b* also show a reference axis 9, oriented parallel to the longitudinal axis B of the valve, on which a coordinate of a point representative of the position of the oscillating arm 3 is shown (for instance the point of a lower edge 7 of the second end 2 which, at any moment, is located at the longitudinal axis B). In the following description, "position Z" is used to refer to this coordinate. Given that the end 5 normally acts in abutment against the upper end of the valve 2, the current position Z is also representative of the position of the valve 2.

In FIG. 2*a*, in particular, the oscillating arm 3 is shown in a first end-of-stroke position or closed position, corresponding to a closed position value $Z_{SUP}$ on the reference axis 9. When in this position, the oscillating arm 3 is disposed in contact with the polar head of the closing electromagnet 6*a* and therefore the position of the latter is represented by the closed position value $Z_{SUP}$. It will be appreciated that, in this situation, the second end 5 of the oscillating arm 3 may be detached from the upper end of the valve 2 since this valve 2 reaches a limit position $Z_{LIM}$, in which it is kept closed. Even during a phase of detachment, however, the current position Z is representative of the actual position of the valve 2: values of the current position Z greater than the limit position $Z_{LIM}$ show that the valve 2 is closed and is exactly in the limit position $Z_{LIM}$.

In FIG. 2*b*, however, the oscillating arm 3 is shown in a second end-of-stroke position, i.e. a position of maximum opening, in which it is disposed in contact with the polar head of the opening electromagnet 6*b*. This position of maximum opening, which corresponds to a maximum opening value $Z_{INF}$ on the reference axis 9, is therefore also representative of the position of the polar head of the closing electromagnet 6*a* and also coincides with the position of maximum opening of the valve 2.

In both FIG. 2*a* and FIG. 2*b*, moreover, the oscillating arm 3 is shown, in dashed lines, in the rest position, which is taken as the origin of the reference axis 9.

Figure 1:
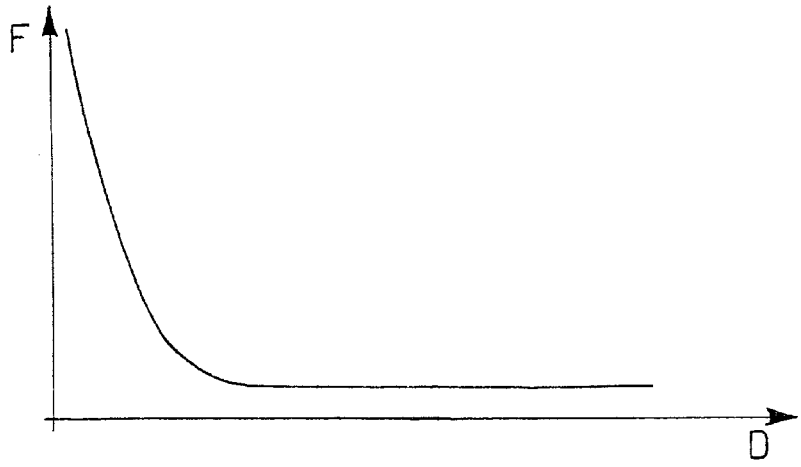
FIG. 1 is a graph relating to an electromagnetic actuator.
Figure 3:
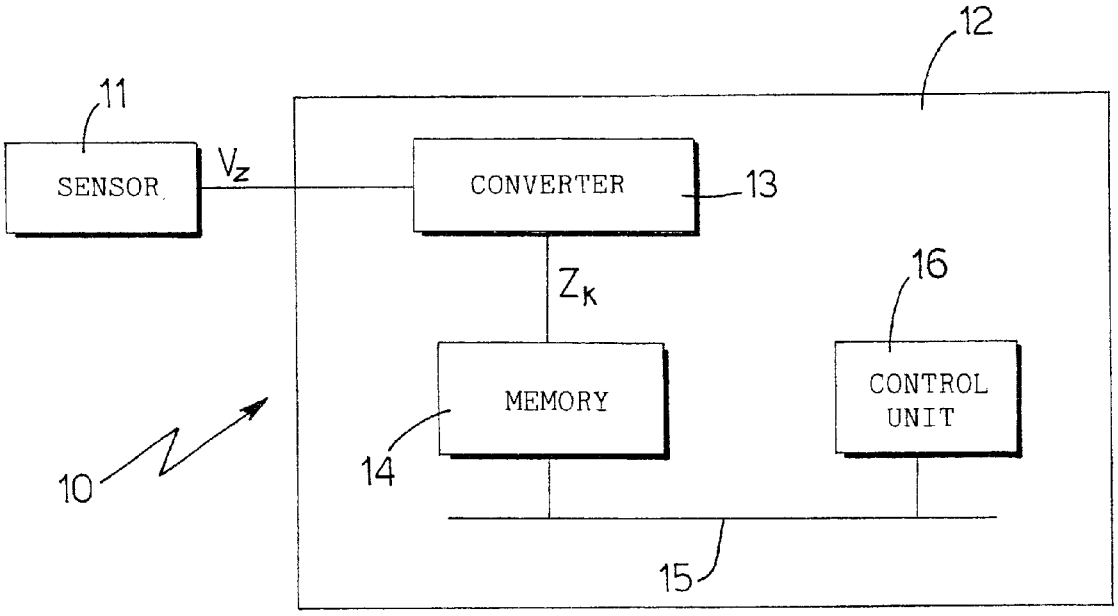
FIG. 3 is a simplified block diagram relating to the control method of the present invention.

As shown in FIG. 3, in a control system 10 of the actuator 1, a position sensor 11, of known type, supplies a position signal $V_Z$ representative of the current position Z of the oscillating arm 3 to an electronic control unit 12. The electronic control unit 12 is provided with a converter 13 which receives as input the position signal $V_Z$, samples it at a predetermined sampling frequency and, in a manner known per se, supplies as output position values $Z_K$ correlated with sampling values $V_K$ assumed by the position signal $V_Z$ at each sampling moment K.

The position values $Z_K$ acquired are stored in a memory 14, which, by means of a bus 15, is connected to a control unit 16 adapted to carry out procedures for the control of the operation of the engine. Moreover, the closed position value $Z_{SUP}$ and the maximum opening position value $Z_{INF}$ are also stored in the memory 14.

Figure 4:
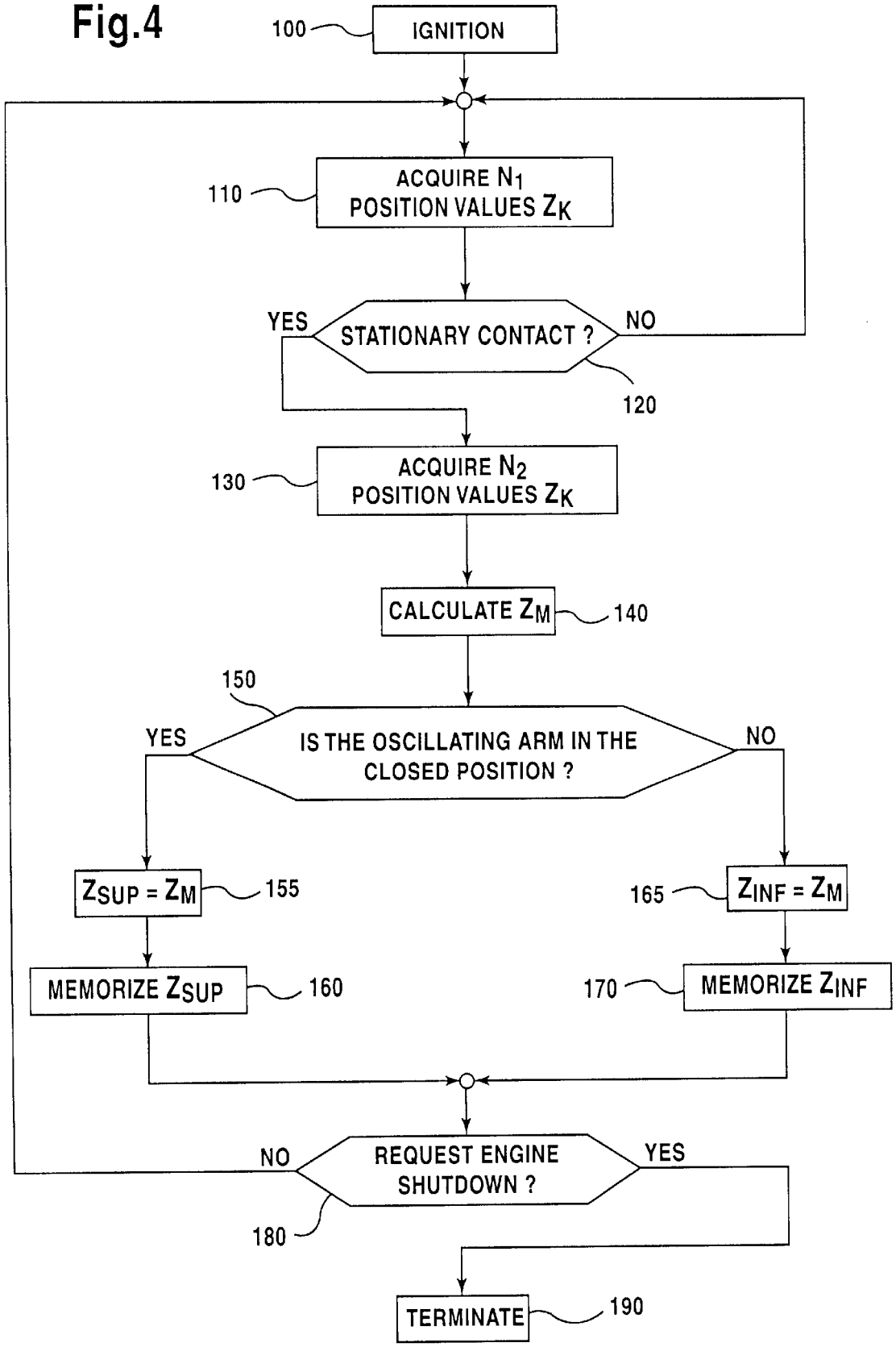
FIG. 4 is a flow diagram relating to the present method.

With reference to FIG. 4, the method of the present invention provides that, following ignition of the engine (block 100), a first number $N_1$, for instance 50, of position values $Z_K$ (block 110) is initially acquired.

Subsequently, a test is carried out to check whether there is a condition of stationary contact of the valve 2, which exists when the oscillating arm 3 is held in the closed position $Z_{SUP}$ or the position of maximum opening $Z_{INF}$ (block 120). In particular, it is checked whether the difference between the maximum position value $Z_{KMAX}$ and the minimum position value $Z_{KMIN}$ among the $N_1$ values of position $Z_K$ acquired is smaller than a predetermined range threshold Δ.

If the outcome of the test is negative (output NO from the block 120), a new set of $N_1$ values of position $Z_K$ is again acquired (block 110). If, however, the stationary conditions are verified (output YES from the block 120), a second number $N_2$, for instance 200, of position values $Z_K$ are acquired (block 130), of which a mean value $Z_M$ (block 140) is then calculated according to the equation:

$$Z_M = \frac{1}{N_2}\sum_{K=1}^{2} Z_K \tag{1}$$

It is then checked whether the oscillating arm 3 is in the closed position, verifying whether the mean value $Z_M$ is positive (block 150). If so (output YES from the block 150), i.e. if the oscillating arm 3 is in contact with the polar head of the closing electromagnet 6*a*, the closed position $Z_{SUP}$ is set to $Z_M$ (block 155) and then memorised (block 160). If the mean value $Z_M$ is negative (output NO from the block 150) and therefore the oscillating arm 3 is in the position of maximum opening $Z_{INF}$, in contact with the polar head of the opening electromagnet 6*b*, the position of maximum opening $Z_{INF}$ is set to the mean value $Z_M$ (block 165) and memorised (block 170).

Subsequently, it is checked whether stoppage of the engine has been requested (block 180). If so (output YES from the block 180), the estimation procedure is terminated (block 190); otherwise (output NO from the block 180), a set of $N_1$ values of position $Z_K$ is again acquired (block 110).

Figure 5:
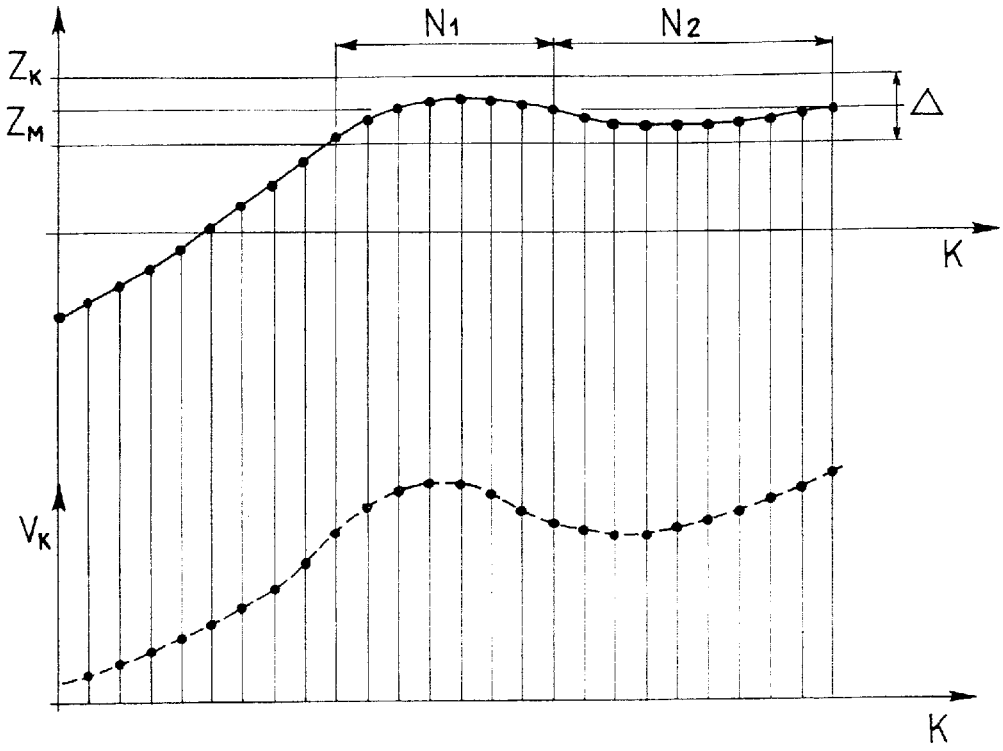
FIGS. 5 and 6 are graphs relating to curves of magnitudes of the present method.

FIG. 5 shows, by way of example, a curve of the position values $Z_K$ (represented by points connected by a continuous line) and of the corresponding sampling values $V_K$ (shown by points connected by dashed lines), as a function of the generic moment of sampling K; the first and the second number $N_1$, $N_2$ of position values acquired and the range threshold Δ are also shown.

In practice, the end-of-stroke positions of the oscillating arm 3 (closed position and position of maximum opening) are estimated when it is recognised that the oscillating arm 3 is substantially stationary, i.e. when its actual position Z has not changed significantly for a time sufficient to acquire the first number of position values $Z_K$. In this case, further position values $Z_K$ are acquired and their mean value $Z_M$ is calculated. In particular, the second number $N_2$ of position values $Z_K$ acquired must be high enough so that any disturbances, for instance noise present in the position signal $V_Z$, has no impact on the calculation of the mean value $Z_M$. The mean value $Z_M$ is then memorised as a new closed position value $Z_{SUP}$, if positive, or as a maximum opening position value $Z_{INF}$, if negative. Given that, in each engine cycle, the valve 2 and therefore the oscillating arm 3 stop at least once in the closed position and in the position of maximum opening, both the values of the closed position $Z_{SUP}$ and of the position of maximum opening $Z_{INF}$ can be rapidly updated in succession. Moreover, the estimate of the end-of-stroke positions is repeated each time that the condition of stationary contact is verified, until the stoppage of the engine is requested.

The estimation method as described has the following advantages.

In the first place, it is possible to update the estimate of the end-of-stroke positions in real time, given that the estimation procedure is carried out each time that stationary contact conditions are detected. Consequently, a precise estimate of the positions of the polar heads of the closing and opening electromagnets 6*a* and 6*b* is also supplied in real time.

It is therefore possible to obtain a correct measurement of the distance intervening between the polar heads of the electromagnets and the oscillating arm, irrespective of variations due to heat expansion.

In particular, the method of the present invention may be advantageously used for instance in the case of the method for the control of electromagnetic actuators as disclosed in Italian Patent Application B099A000594 of Nov. 5, 1999 filed in the name of the applicants.

This Patent Application relates to the control of an electromagnetic actuator, substantially of the type of the actuator 1 described in FIGS. 2*a* and 2*b*, to which reference will continue to be made. According to the method disclosed in the above-mentioned Application, a feedback control of the actual position Z and of an actual velocity V of the valve 2 is carried out, using, as the control variable, the net force applied by means of the opening and closing electromagnets 6*a* and 6*b* to the oscillating arm 3, which actuates this valve 2. For this purpose, by means of a model based on a dynamic system, an objective force value $F_O$ to be exerted on the oscillating arm 3 is calculated as a function of an actual position, an actual velocity, a reference position and a reference velocity of the valve. The dynamic system is in particular described by the following matricial equation:

$$\begin{bmatrix} \dot{Z} \\ \dot{V} \end{bmatrix} = \begin{bmatrix} 0 & 1 \\ K/M & B/M \end{bmatrix} \begin{bmatrix} Z \\ V \end{bmatrix} + \begin{bmatrix} 0 \\ 1/M \end{bmatrix} F \tag{2}$$

in which Z and V are the time derivatives of the actual position Z and of the actual velocity V respectively, F is the net force exerted on the oscillating arm 3, K is an elastic constant, B is a viscous constant and M is an equivalent total mass. In particular, the net force F and the actual position Z respectively represent an input and an output of the dynamic system.

Moreover, the objective force value $F_0$ is calculated by the equation:

$$F_O=(N_1Z_R+N_2V_R)-(K_1Z+K_2V) \tag{3}$$

in which $N_1$, $N_2$, $K_1$ and $K_2$ are gains that may be calculated by applying well-known robust control techniques to the dynamic system represented by equation (2).

Subsequently, the current values to be supplied to the closing and opening electromagnets 6*a* and 6*b* are calculated so that the net force exerted on the oscillating arm 3 has a value equal to the objective force value $F_O$.

Clearly, given that the net force applied, as discussed above, is highly dependent on the actual distance intervening between the oscillating arm 3 and the polar heads of the closing and opening electromagnets 6*a* and 6*b*, the use of the present estimation method in the case described in the above-mentioned Patent Application makes it possible substantially to improve the accuracy and reliability of the control.

It will be appreciated that modifications and variations may be made to the method as described, without departing from the scope of the present invention.

Figure 6:
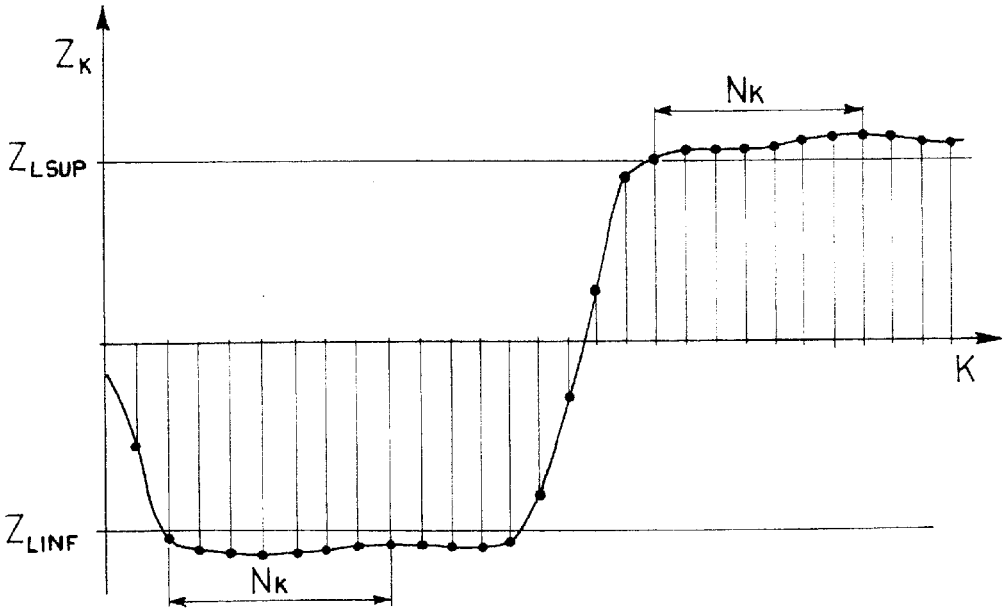

In particular, the condition of stationary contact of the oscillating arm 3 (FIG. 4, block 120) could be evaluated in a different way. For instance, it is possible to check whether a minimum number N. of consecutive position values $Z_K$ are alternately greater than an upper limit position $Z_{LSUP}$ (oscillating arm 3 in the closed position) or lower than a lower limit position $Z_{LINF}$ (oscillating arm 3 in the position of maximum opening) as shown in FIG. 6. As an alternative, it is possible to verify whether the velocity of the oscillating arm is below a predetermined threshold, or whether the currents supplied to the closing or opening electromagnets 6*a* and 6*b* continue to be substantially constant.

What is claimed is:

1. A method for estimating the end-of-stroke positions of moving members of electromagnetic actuators for the actuation of intake and exhaust valves in internal combustion engines, in which an actuator (1) is coupled to a respective intake or exhaust valve (2) and comprises a moving member (3) actuated magnetically in order to control the movement of the valve (2), a sensor (11) supplying a position signal ($V_Z$) representative of a current position (Z) of this moving member (3) and a first and a second electromagnet (6*a*, 6*b*) disposed on opposite sides of this moving member (3), wherein this moving member (3) can move between a first end-of-stroke position ($Z_{SUP}$) in which it is disposed in contact with the first electromagnet (6*a*) and a second end-of-stroke position ($Z_{INF}$) in which it is disposed in contact with the second electromagnet (6*b*), which method is characterised in that it comprises the stages of:

a) checking whether a condition of stationary contact of the moving member (3) exists (110, 120); and b) determining a value ($Z_M$) correlated with this current position (Z) (130, 140), if the condition of stationary contact is verified.

2. A method as claimed in claim 1, characterized in that the stage a) of checking whether the condition of stationary contact exists comprises the stage of:

a1) acquiring a first number ($N_1$) of position values ($Z_K$) correlated with sampling values ($V_K$) of the position signal ($V_Z$) at predetermined sampling moments (110).

3. A method as claimed in claim 2, characterised in that the stage a) of checking whether the condition of stationary contact exists further comprises the stage of:

a2) checking whether the difference between a maximum position value ($Z_{KMAX}$) and a minimum position value ($Z_{KMIN}$) is lower than a range threshold (D).

4. A method as claimed in claim 2, characterised in that the stage a) of checking whether the condition of stationary contact exists further comprises the stage of:

a3) checking whether the position values ($Z_K$) acquired are greater than an upper limit position ($Z_{LSUP}$), a4) checking whether the position values ($Z_K$) acquired are lower than a lower limit position ($Z_{LSUP}$).

5. A method as claimed in claim 1, characterised in that the stage b) of determining a value ($Z_M$) comprises the stages of:

b1) acquiring a second number (N2) of position values ($Z_K$)correlated with sampling values ($V_K$) of the position signal ($V_Z$) at predetermined sampling moments (130); and b2) calculating a mean value ($Z_M$) of the position values ($Z_K$)acquired (140).

6. A method as claimed in claim 5, characterised in that the stage b2) of calculating the mean value ($Z_M$) is followed by the stages of:

b3) determining whether the moving member (3) is in the first end-of-stroke position (150); and b4) determining whether the moving member (3) is in the second end-of-stroke position (150).

* * * * *